United States Patent [19]

Zacharias

[11] Patent Number: 4,502,362

[45] Date of Patent: Mar. 5, 1985

[54] MOUTH ORGAN

[75] Inventor: Ernst Zacharias, Trossingen, Fed. Rep. of Germany

[73] Assignee: Matth. Hohner AG, Trossingen, Fed. Rep. of Germany

[21] Appl. No.: 532,355

[22] Filed: Sep. 15, 1983

[30] Foreign Application Priority Data

Sep. 22, 1982 [DE] Fed. Rep. of Germany ..... 3235034

[51] Int. Cl.[3] ..... G10D 7/12

[52] U.S. Cl. ..... 84/377; 84/DIG. 14

[58] Field of Search ..... 84/377–379, 84/DIG. 14

[56] References Cited

U.S. PATENT DOCUMENTS 2,407,312 9/1946 Magnus ..... 84/377

2,584,572 2/1952 Gaukstern ..... 84/377

FOREIGN PATENT DOCUMENTS 119499 2/1926 Switzerland ..... 84/377

*Primary Examiner*—Benjamin R. Fuller

[57] ABSTRACT

A mouth organ comprising two molded plastic half air slot bodies with integral voice reeds. The half air slot bodies are joined together and are protected externally with respective cover shell halves which are also preferably molded plastic parts.

20 Claims, 2 Drawing Figures

MOUTH ORGAN

BACKGROUND OF THE INVENTION (1) Field of the Invention

The present invention relates to musical instruments and particularly to harmonicas. More specifically, this invention is directed to improvements in and to mouth organs. Accordingly, the general objects of the present invention are to provide novel and improved instruments of such character.

(2) Description of the Prior Art

Mouth organs comprise, in their simplest construction, an air slot defining body which will typically be formed of wood. Metallic voice plates, which include the voice reeds, will be affixed to both the upper and lower sides of the air slot body, one of the voice plates increasing the pressure reeds while the other includes the suction reeds. The voice reeds must be tuned at least once. The sides of the voice plates which face away from the air slot defining body will be protected by a cover shell which, typically, will be comprised of thin sheet metal.

The above-briefly described prior art mouth organ requires, for construction of the parts thereof, a large number of work operations which must be performed on different materials and, in addition, considerable time is required to assemble the instrument from the finished parts. This labor intensive construction and assembly has been reflected in the relatively high cost of the instruments. There has, accordingly, been a long-standing desire for a mouth organ which is less expensive to manufacture when compared to prior art instruments of similar character, and particularly, for a harmonica which requires less labor for parts manufacture and assembly.

SUMMARY OF THE INVENTION

The present invention overcomes the above-briefly discussed disadvantages of the prior art by providing a novel and improved mouth organ wherein the air slot defining body and voice plates are defined by a pair of molded plastic parts which may be placed in proper registration and bonded together. A mouth organ in accordance with the present invention further comprises a cover shell, desirably also molded from plastic, which may be snapped onto the integrated pair of air slot body and voice plate defining parts.

In accordance with the present embodiment, the air slot defining body of a mouth organ in accordance with the present invention is of two-piece construction with the two parts thereof respectively having formed, integrally therewith, the pressure and suction reeds. Accordingly, a mouth organ in accordance with the present invention does not include separate voice plates. The two parts of the air slot defining body, when assembled, preferably define a junction plane which is located approximately in the median plane of the air slot body. The air slot defining body parts are preferably injection-molded from a suitable plastic and are joined together by any appropriate methodology, i.e., adhesive bonding, ultrasonic welding, etc.

The cover shell of a mouth organ in accordance with the present invention is preferably also of two-piece construction and is formed, preferably by injection-molding, from plastic. The cover shell portions cooperate with the air slot defining body such that the shell portions may preferably be snapped onto the body for ease of assembly and subsequent disassembly for cleaning of the instrument.

The four molded parts which define a mouth organ in accordance with the present invention may be formed from a transparent plastic thus imparting a very desirable asthetic effect to the instrument.

BRIEF DESCRIPTION OF THE DRAWING

The present invention may be better understood and its numerous objects and advantages will become apparent to those skilled in the art by reference to the accompanying drawing wherein like reference numerals refer to like elements in the several Figures and in which.

DESCRIPTION OF THE DISCLOSED EMBODIMENT

Figure 1:
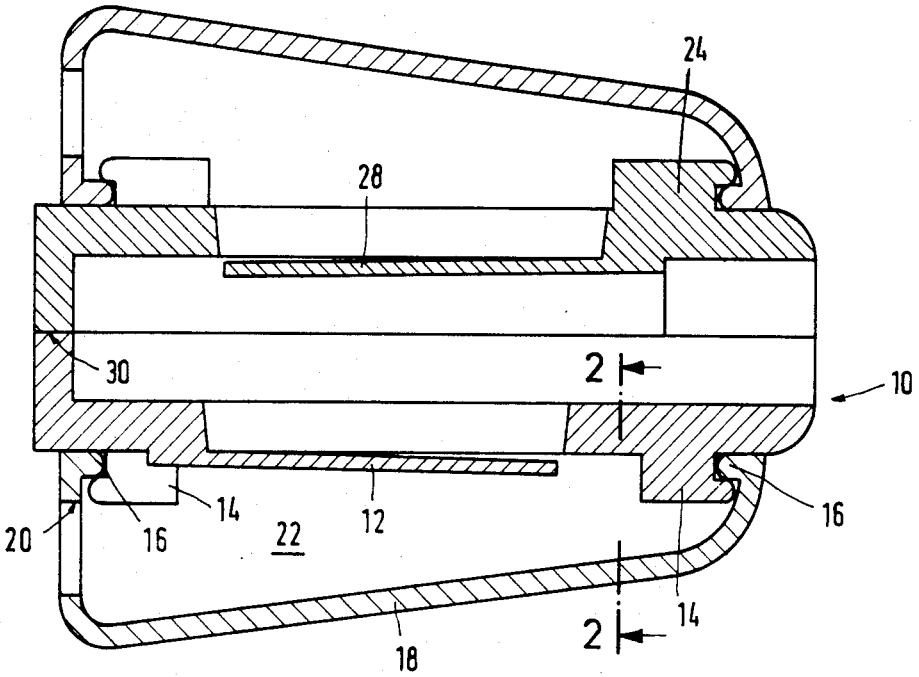
FIG. 1 is a cross-sectional side elevation view of a mouth organ in accordance with the present invention.

With reference to the drawing, FIG. 1 is a sectional view through an air slot of a mouth organ in accordance with the invention. The mouth organ is comprised of an air slot body and a cover shell. The air slot body is defined by a molded lower portion or half air slot body which has been indicated generally at 10. Body half 10 is comprised of plastic and is formed by injection-molding. The suction reeds 12 of the instrument are integral with body half 10. Air slot body half 10 cooperates with an upper air slot body half 24, also formed by injection-molding, with which the pressure reeds 28 are integral.

Since air slot body halves 10 and 24 are substantially identical, with the exception to be discussed below, the following description will be directed primarily to body half 10. Body half 10 is formed with integral forward and rearwardly disposed locking lugs 14. Lugs 14 define grooves which are engaged, when the instrument is assembled, by foot edges 16 of a cover shell 18. The shell 18 is also an injection-molded plastic part and may be easily installed and subsequently removed in order to clean the instrument. The foot edges 16 of shell 18 snap into the grooves in the lugs 14 on body half 10 and disassembly is possible by engagement of the sound orifices 20 which are defined by shell 18.

Figure 2:
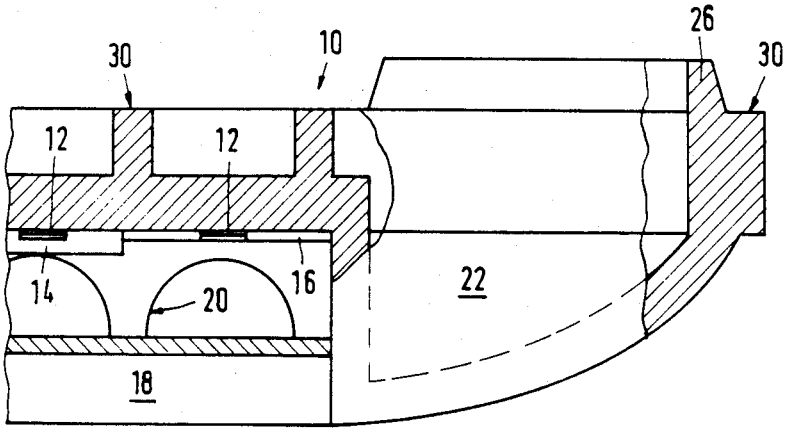
FIG. 2 is a partial cross-sectional front elevation view taken along line 2—2 of FIG. 1.

As may be seen from FIG. 2, at the side edges of the instrument the molded body halves, for example body half 10, are prolonged by a terminal piece 22 which laterally adjoins the cover shell 18 and then terminates with a rounded edge. This terminal region is hollow thus facilitating molding and minimizing the amount of material required to fabricate the body halves. On the edge which faces the upper body half 24, the terminal piece 22 of body half 10 is provided with a locating projection 26 which will typically be U-shaped.

The upper half 24 of the air slot body differs from the lower half 10 by the absence of the locating projection 26. Rather, the upper molded part 24 is provided with a recess which is complementary in shape to projection 26 whereby the two halves of the air slot body may be easily brought into registration.

Once the air slot body halves 10 and 24 are in registration, they will be permanently joined together at their abutting surfaces, these surfaces defining the plane indicated at 30. The joining of the two molded air slot body halves may be accomplished by means of a suitable adhesive or by welding. If the two parts are to be joined by welding, ultrasonic welding will typically be employed and conductor pieces will be provided in the appropriate places in the manner known in the art.

It is particularly noteworthy that, in the fabrication of a mouth organ in accordance with the present invention, tuning of the pressure and suction reeds is not necessary.

It is to be understood that the invention is not limited to the illustration described and shown herein, which is deemed to be merely illustrative of the best mode of carrying out the invention and which is susecptible to modification of form, size, arrangement of pairs and details of operation. The invention rather is intended to encompass all such modifications which are within its spirit and scope as defined by the claims.

What is claimed is:

1. A mouth organ, said mouth organ having plural air slots and sets of pressure and suction voice reeds, said organ comprising:

a first molded plastic body portion, said first body portion defining part of all of the air slots, said first body portion also including a first set of integral voice reeds;

a second molded plastic body portion, said second body portion cooperating with said first body portion to complete the definition of the air slots, said second body portion having integral therewith a second set of voice reeds, said first and second body portions being in abutting relationship and forming an air slot body with integral oppositely disposed sets of pressure and suction voice reeds; and cover shell means, said cover shell means engaging said air slot body and defining the sound orifices of the mouth organ.

2. The mouth organ of claim 1 wherein said body portions each define approximately one half of said air slot body.

3. The mouth organ of claim 1 wherein said body portions have abutting surfaces which define a plane.

4. The mouth organ of claim 2 wherein said body portions have abutting surfaces which define a plane.

5. The mouth organ of claim 1 wherein said body portions are bonded together to form an integral air slot body member.

6. The mouth organ of claim 2 wherein said body portions are bonded together to form an integral air slot body member.

7. The mouth organ of claim 3 wherein said body portions are bonded together to form an integral air slot body member.

8. The mouth organ of claim 4 wherein said body portions are bonded together to form an integral air slot body member.

9. The mouth organ of claim 1 wherein said cover shell means comprises first and second cover shells which respectively removably engage said first and second body portions.

10. The mouth organ of claim 3 wherein said cover shell means comprises first and second cover shells which respectively removably engage said first and second body portions.

11. The mouth organ of claim 4 wherein said cover shell means comprises first and second cover shells which respectively removably engage said first and second body portions.

12. The mouth organ of claim 7 wherein said cover shell means comprises first and second cover shells which respectively removably engage said first and second body portions.

13. The mouth organ of claim 8 wherein said cover shell means comprises first and second cover shells which respectively removably engage said first and second body portions.

14. The mouth organ of claim 3 wherein a first of said body portions includes a locating projection and the other of said body portions is provided with a locating recess which is complementary in shape to said projection.

15. The mouth organ of claim 10 wherein a first of said body portions includes a locating projection and the other of said body portions is provided with a locating recess which is complementary in shape to said projection.

16. The mouth organ of claim 13 wherein a first of said body portions includes a locating projection and the other of said body portions is provided with a locating recess which is complementary in shape to said projection.

17. The mouth organ of claim 1 wherein said body portions each include at least a pair of locking lugs, the locking lugs on the first and second body portions respectively extending outwardly therefrom in opposite directions, said locking lugs defining grooves, and wherein said cover means includes locking projections which may be engaged in and disengaged from said locking lug grooves.

18. The mouth organ of claim 8 wherein said body portions each include at least a pair of locking lugs, the locking lugs on the first and second body portions respectively extending outwardly therefrom in opposite directions, said locking lugs defing grooves, and wherein said cover means includes locking projections which may be engaged in and disengaged from said locking lug grooves.

19. The mouth organ of claim 13 wherein said body portions each include at least a pair of locking lugs, the locking lugs on the first and second body portions respectively extending outwardly therefrom in opposite directions, said locking lugs defing grooves, and wherein said cover shells each include locking projections which may be engaged in and disengaged from said locking lug grooves.

20. The mouth organ of claim 16 wherein said body portions each include at least a pair of locking lugs, the locking lugs on the first and second body portions respectively extending outwardly therefrom in opposite directions, said locking lugs defing grooves, and wherein said cover shells each include locking projections which may be engaged in and disengaged from said locking lug grooves.

* * * * *